US005816039A

United States Patent [19]

Novotny et al.

[11] Patent Number: 5,816,039

[45] Date of Patent: Oct. 6, 1998

[54] POSITIVE AND NEGATIVE PRESSURE ROTOR CLEANING METHOD FOR A ROTOR SPINNING MACHINE

[75] Inventors: Vojtech Novotny, Dukelska; Zdenek Spindler, Nemcove, both of Czechoslovakia

[73] Assignee: Rieter Deutschland GmbH, Ingolstadt, Germany

[21] Appl. No.: 833,586

[22] Filed: Apr. 7, 1997

Related U.S. Application Data

[62] Division of Ser. No. 510,292, Aug. 2, 1995, Pat. No. 5,666,798.

[30] Foreign Application Priority Data

Aug. 3, 1994 [CS] Czechoslovakia ..... 1863-94

[51] Int. Cl.[6] ..... D01H 11/00

[52] U.S. Cl. ..... 57/302; 57/304; 57/407

[58] Field of Search ..... 57/301, 302, 304, 57/305, 407

[56] References Cited

U.S. PATENT DOCUMENTS

| | | | |
|---|---|---|---|
| 3,859,779 | 1/1975 | Furstenburg . | |
| 3,869,851 | 3/1975 | Muller . | |
| 4,058,963 | 11/1977 | Stahlecker . | |
| 4,125,991 | 11/1978 | Stahlecker . | |
| 4,135,354 | 1/1979 | Stahlecker . | |
| 4,315,399 | 2/1982 | Pfeifer et al. . | |
| 4,339,914 | 7/1982 | Pfeifer | 57/302 |
| 4,403,472 | 9/1983 | Lattion et al. . | |
| 4,893,462 | 1/1990 | Braun et al. | 57/302 |

FOREIGN PATENT DOCUMENTS

| | | |
|---|---|---|
| 219283 | 7/1985 | Czechoslovakia . |
| 234432 | 3/1987 | Czechoslovakia . |
| 240753 | 8/1987 | Czechoslovakia . |
| 234501 | 11/1987 | Czechoslovakia . |
| 2735311 | 2/1979 | Germany . |

*Primary Examiner*—William Stryjewski
*Attorney, Agent, or Firm*—Dority & Manning

[57] ABSTRACT

A method and device of cleaning the rotor (6) of a rotor spinning machine are provided in which, after the opening of a spinning unit, there are sucked off from the rotor (6) fibres and impurities being released from the inner surface of the rotor by pressure air applied to said inner surface. The cleaning pressure air is led into the rotor (6) in at least two air streams producing in the rotor (6) a symmetrical streaming in one and the same direction and the supplied air, together with the released impurities, is sucked off through the centre of the inlet aperture (63) of the rotor (6).

10 Claims, 5 Drawing Sheets

POSITIVE AND NEGATIVE PRESSURE ROTOR CLEANING METHOD FOR A ROTOR SPINNING MACHINE

This is a Division of application Ser. No. 08/510,292, filed Aug. 2, 1995, now U.S. Pat. No. 5,666,798.

BACKGROUND OF THE INVENTION

The present invention relates to a method of cleaning the rotor of a rotor spinning machine in which, after the opening of a spinning unit, there are sucked off from the rotor fibres and impurities released from the inner surface of the rotor by pressure air applied to said inner surface. The invention also relates to a device for carrying out the method.

In rotor spinning machines, the transformation of singled out fibres into yarn, in particular in the production of cotton yarn, involves the collection of impurities on the collecting surface of the rotor. Impurities consisting mostly of plant rests are comprised directly in the sliver, get released in the singling out process, and some of them get into the rotor, In the rotor, some of the entering impurities are retained in the fibre band and subsequently in the yarn produced by the fibre band twisting and leaving the rotor. The remaining impurities stick in the rotor, cling to its inner surface, and can cause ruptures of the yarn being spun. Together with the impurities, remaining in the rotor is also the part of the fibre band that has not been transformed into yarn, and a number of singled out fibres that have entered the rotor from the singling out device before the spinning unit stops after a yarn rupture, whatever may have been the yarn rupture cause.

For this reason, before any attempt at reinstalling the spinning process at a spinning unit affected by yarn rupture, the inner space of the rotor must be cleaned to restore the yarn production conditions.

The rotor can be cleaned manually or by automatic means which can be either a component part of each spinning unit, as disclosed for instance in the CS 219 283 (CH 5935/79), or provided on an attending device adapted to move along the working places of a rotor spinning machine.

In a well-known attending device, the fibre band is sucked off from the rotor through a tube connected to an underpressure source and adapted to deliver the fibre band from the rotor into the attending device. Concurrently or subsequently, inserted into the rotor are mechanical means, such as a needle or a brush, intended to remove deposited impurities from the collecting groove of the rotor.

Thus is arranged for instance the cleaning device disclosed in the inventor's certificate CS 234 432 featuring a revolving sucking-off tube fitted with a revolving drive and adapted to be inserted into the rotor. In the operating position of the cleaning device, the circumference of the revolving sucking-off tube is in contact with the inner edge of the rotor mouth positively sharing the revolving motion of said tube. Simultaneously with the revolving sucking-off tube, a mechanical cleaning device moves into the rotor consisting of a cleaning brush and serves to clean the collecting groove of the rotor.

The drawback of this arrangement consists in the positive rotation of the rotor during the cleaning. This causes fibres existing in the rotor to get wound on the rotating sucking-off tube, which are apt to cause failures.

This drawback has been removed by the cleaning device disclosed in the inventor's certificate CS 240 573 requiring no rotor rotation during the cleaning because into the rotor there is inserted a rotating brush whose cleaning elements are in diameter superior to the maximum inner diameter of the collecting groove of the rotor. The rotating brush is rotatably seated in a cleaning head in which is provided also a suction-off aperture connected to an underpressure source for sucking off the fibre band and impurities from the rotor.

Mechanical cleaning means have a number of drawbacks consisting especially in the contact of the rotor with a foreign solid body, resulting either in excessive wear of the cleaning means or, if the cleaning means are too hard, in damage to the rotor. Once worn, the cleaning means are unsuitable to clean the rotor, and must be either replaced by new ones or adjusted. The contact of the cleaning means with the not yet stopped rotor may provoke sparking involving the risk of ignition of the lint around the cleaning area. Small diameter rotors lack space sufficient for simultaneous sucking off of the fibre band and inserting of the mechanical cleaning means into the rotor.

Also known is pneumatic cleaning of the rotor comprising the sucking off of the fibre band from the rotor with simultaneous or subsequent application of a pressure air stream to the soiled parts of the inner surface of the rotor.

Simpler is the pneumatic cleaning of passive rotors, i.e., those in which a rotor having no ventilation holes is seated in an underpressure chamber. Such passive rotors can be cleaned without opening the spinning unit, just by supplying a pressure air stream into the rotor, as disclosed for instance in the DE OS 27 35 311 in which two jets provided in the cover of the underpressure chamber lead into the inner space of the rotor two streams of pressure air, one of them directed to the collecting groove of the rotor and the other to the inner circumference of the rotor. The two streams of cleaning air are led into the rotor under different angles with respect to the tangent lines passing through the points of their incidence on the inner circumference of the rotor. The fibres and impurities are in this arrangement sucked off across the edge of the rotor into the underpressure chamber. Such rotors can be cleaned in the same way also in the open state of the spinning unit, with the jets arranged in a cleaning device adapted to be put in contact-like vicinity of the rotor.

The effectiveness of this arrangement is based on the fact that the rotor turns; consequently, it cannot be used in active rotors producing underpressure by their rotation because they are fitted with ventilation holes.

Such active rotors can be cleaned in the stopped state only by opening the spinning unit, sucking off the fibre band through a tube, putting to the rotor a head fitted with a pressure air jet revolving around the rotor axis and leading the pressure air stream onto the soiled surface parts of the rotor. However, part of the pressure air with some impurities gets out into the surrounding space. Another drawback consists in the risk of the fibres getting wound on the revolving jet body and thus locking it.

Another well-known device is disclosed in the inventor's certificate CS 234 501. After the opening of the spinning unit, a cleaning head is placed to the rotor comprising a channel for removing impurities connected to an underpressure source, stationary jets for pressure air supply, and an open channel for ambient air supply.

Such a device can be used only in large-diameter rotors, which nowadays, are not generally used due to the increasing r.p.m. speed. Besides, such devices can remove the fibre bands from the rotor, but not impurities clung to the inner surface of the rotor.

In all the above mentioned methods of pneumatic rotor cleaning, there is a tendency of the pressure air supplied to the rotor to get out from the rotor inner space across its edges involving the risk of fibres and impurities getting out into the ambient space. In some of them, there is also a risk that the fibre band escapes, subsequently getting into the machine and possibly causing a failure in it.

SUMMARY OF THE INVENTION

The drawbacks of the state of art are eliminated by the method of cleaning the rotor of a rotor spinning machine according to the invention whose principle consists in that the cleaning pressure air is led into the rotor in at least two air streams. This produces in the rotor a symmetrical streaming in one and the same direction and that the supplied air together with the fibres and impurities released from the rotor is sucked off through the center of the inlet aperture of the rotor.

The fibres collected in the rotor are set into rotary motion by the cleaning pressure air, thus released from the rotor surface, and sucked off. The air streams act then upon the inner surface of the rotor and clean it. The fact that fibres and impurities are sucked off through the center of the inlet aperture prevents the cleaning pressure air with impurities from escaping out of the rotor into its ambient space.

To remove more efficiently the fibres gathered in the rotor, the cleaning air supply is at least once interrupted for a predetermined time interval and then resumed.

The time interval of the cleaning air supply before the first interruption can be preferably shorter than the following time intervals of the pressure air supply because in the first part of the interval of the cleaning air supply the gathered fibres are removed from the rotor while the other intervals of the cleaning air supply serve to clean the rotor by removing the impurities.

In cases in which the fibres collected in the rotor are difficult to loosen, such as in synthetic fibres, it is advantageous to supply to the rotor at least one ancillary air stream in a direction different from that of the cleaning air streams creating a symmetrical streaming in the rotor. Such ancillary air stream can be supplied at least before the first interruption of the cleaning air supply or at least during the first interruption of the cleaning air supply. The ancillary air stream serves to loosen, in particular, heavy fibres accumulated in considerable quantity in the rotor.

The principle of the device for carrying out said method consists in that the inlet aperture of the sucking-off tube of the cleaning head is in the cleaning position situated opposite the central part of the inlet aperture of the rotor and that the cleaning jets are situated around the inlet aperture of the sucking-off tube and are directed under one and the same angle to the inner surface of the rotor.

In devices in which the rotor stops before the spinning unit opening, the cleaning head of the cleaning device can be put in its cleaning position in immediate vicinity of the inlet aperture of the rotor equipped with a sensor monitoring its stopped state and connected with a control device of the cleaning device.

In alternative embodiments, the cleaning jets are coupled with a control unit of the attending device, thus permitting interruption of the cleaning air supply to cleaning jets.

The shape of the inlet aperture of the sucking-off tube can be a manifold. From the point of view of the efficiency in sucking-off impurities, an extended shape with an even number of cleaning jets disposed around it appears to be most advantageous.

In the version with an extended inlet aperture of the sucking-off tube, the cleaning jets are situated preferably along the longer side of the extended inlet aperture whose length is preferably equal to the diameter of the inlet aperture of the rotor, and the short sides of the extended inlet aperture of the tube are rounded in a diameter equal or inferior to the diameter of the inlet aperture of the rotor.

This embodiment shows optimum effects because the inlet aperture of the sucking-off tube interrupts the symmetrical streaming of the cleaning air in the rotor.

In some cases it can be more advantageous, especially for design and manufacturing reasons, to shape the inlet aperture of the sucking-off tube as a circular one with a diameter inferior to the diameter of the inlet aperture of the rotor.

For carrying out the method according to the invention, the cleaning device contains next to the sucking-off tube at least one ancillary jet directed to the inner surface of the rotor under an angle different from that of the cleaning jets.

In this embodiment, the ancillary jet can be connected with the control unit of the attending device for obtaining interval like air supply to the ancillary jets.

The cleaning device can be mounted on the attending device that can be coupled with a pressure air source to which are attached outlet jets of the cleaning device. The attending device can be equipped with an underpressure source connected with the sucking-off tube of the cleaning device.

Especially for machines expected to process various sorts of materials quickly succeeding one another, the cleaning jets, and possibly the ancillary jets as well, are adapted to take up various angle positions.

BRIEF DESCRIPTIONS OF THE DRAWINGS

Examples of an embodiment of a device for carrying out the method according to this invention are schematically shown in the accompanying drawings in which.

DETAILED DESCRIPTION OF THE PREFERRED EMBODIMENTS

Figure 1:
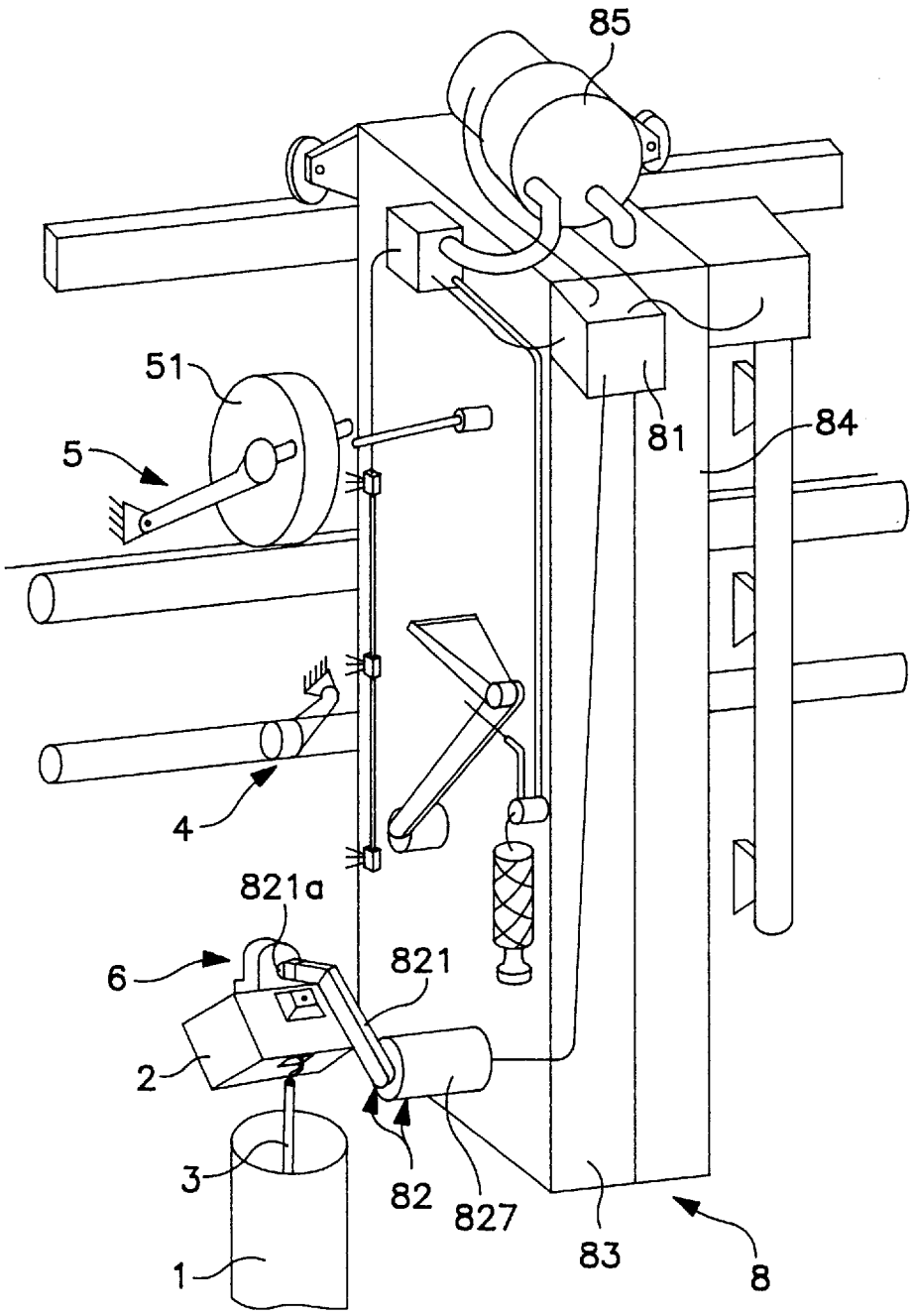
FIG. 1 is an axonometric view of a working place of a machine attended by an attending device of which only some mechanisms are shown.
Figure 2:
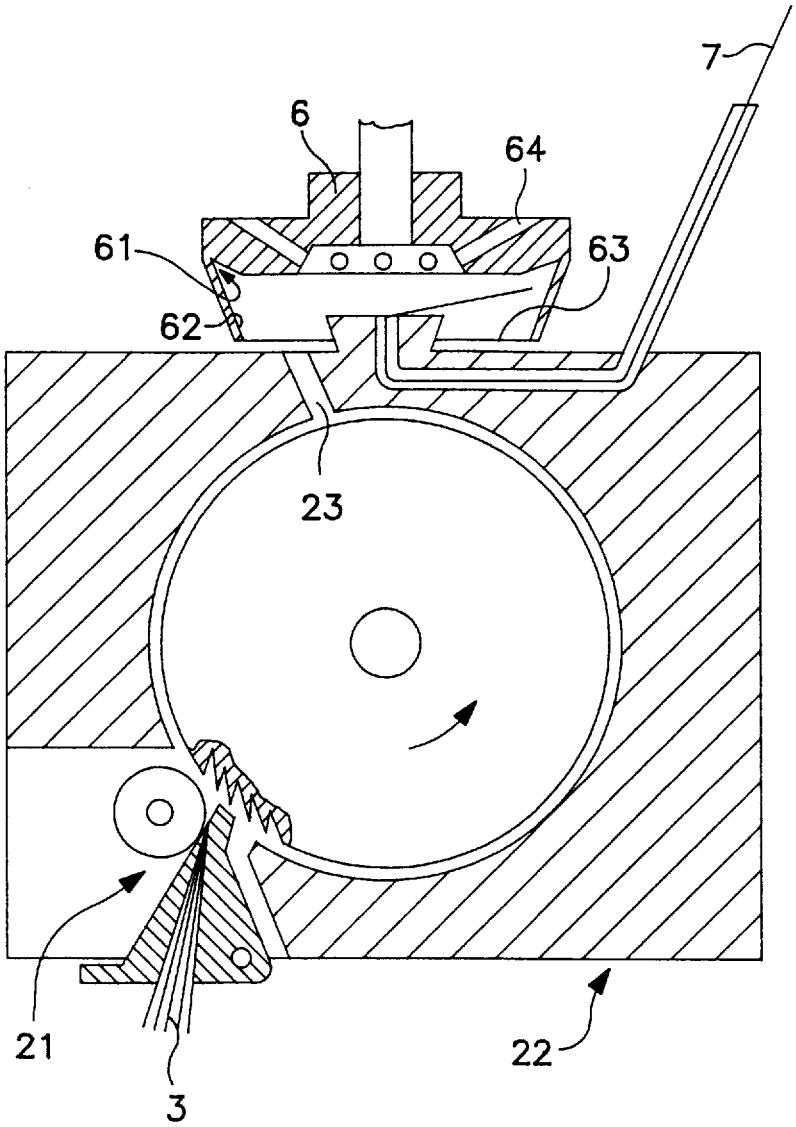
FIG. 2 is a sectional view of a spinning unit.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. Additionally, the numbering of components is consistent throughout the application, with the same components having the same number throughout.

Rotor spinning machines consist of a plurality of working places arranged next to each other. Each working place comprises a sliver can 1 and a spinning unit 2 containing a feed mechanism 21 for sliver 3 to which is related a singling-out mechanism 22 connected by a feed channel 23 used to feed singled-out fibres to a rotor 6 in which singled-out fibres are, in a well-known manner, collected and, on its collecting surface 61, laid into a fibre band transformed by the rotary motion of the rotor 6 into yarn 7 drawn-off from the rotor 6 by a well-known draw-off mechanism 4 and wound on a bobbin 51 by a likewise well-known winding up device 5.

Together with the singled-out fibres, also a part of impurities contained in the sliver 3, enters the inner space of the rotor 6, and a portion of this part comes to stick on the inner faces of the rotor 6, in particular on the collecting surface 61 of the rotor 6, but also on the gliding surface 62 of the rotor 6. Some impurities can be deposited also on the inner surface near the inlet aperture 63 of the rotor 6, that by itself is not a functional surface, impeding the singled-out fibres from being fed or the yarn 7 from being produced. However, in course of time, a relatively thick layer of such particles can break off and glide onto the collecting surface 61 of the rotor 6 where it gets into the fibre band and risks rupture, or impairs the appearance, of the yarn 7 being produced.

In processing cotton, impurities consist in particular of line, sand, fine particles of fibres and plant parts. In processing man-made fibres, impurities contain in particular dressing agent, lubricants, and fibre particles.

Consequently, at least at each spinning process interruption and before any attempt at reinstalling said process, the spinning rotor 6 must be freed of impurities sticking to its inner surface and, at the same time, the fibre band or all fibres gathered in the rotor 6 must be removed from it. This can be done by means provided either in each spinning unit of the machine or on an attending device 8 of the machine adapted to move along the working places of the machine as shown in FIG. 1. The attending device contains a control unit 81 having related thereto specific mechanisms of the attending device 8 serving to ensure the attendance of the working places of the machine. Out of these devices, only the cleaning device 82 of the rotor 6 will be described. For the cleaning of the rotor 6, the attending device 8 must contain also means (not represented) for opening the spinning unit that can be made in any well-known way.

Figure 3:
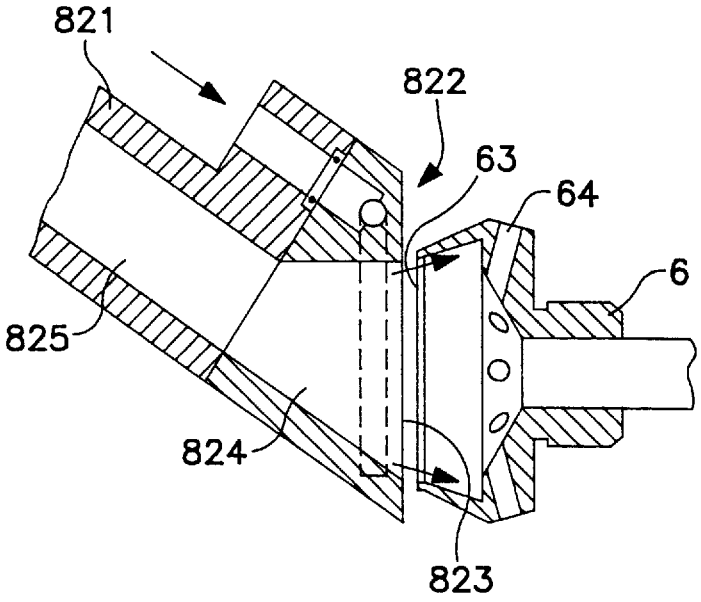
FIG. 3 is a sectional view of a sucking-off tube, of a cleaning head in its cleaning position, and of the rotor.
Figure 4:
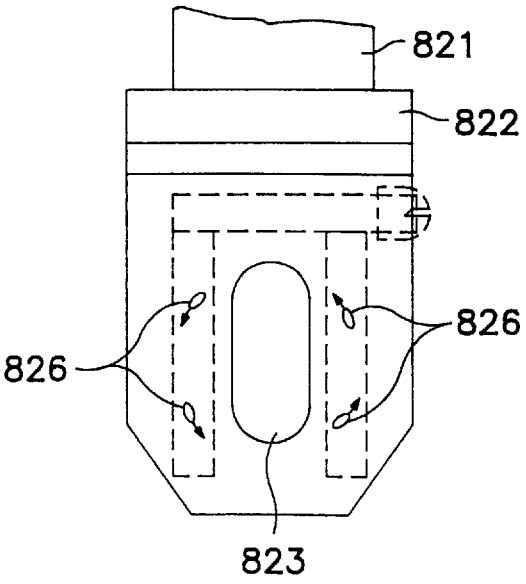
FIG. 4 is a view of the cleaning head shown in FIG. 3 showing also a projection of the inlet aperture of the rotor.
Figure 5:
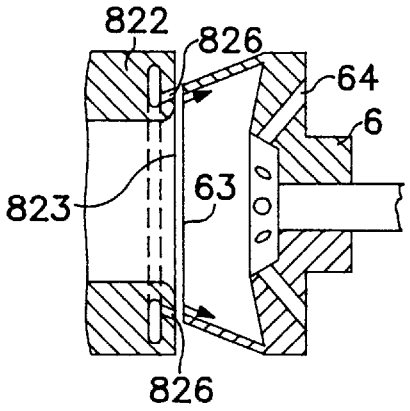
FIG. 5 is a sectional view of another embodiment of the cleaning head in its cleaning position and of the rotor.
Figure 6:
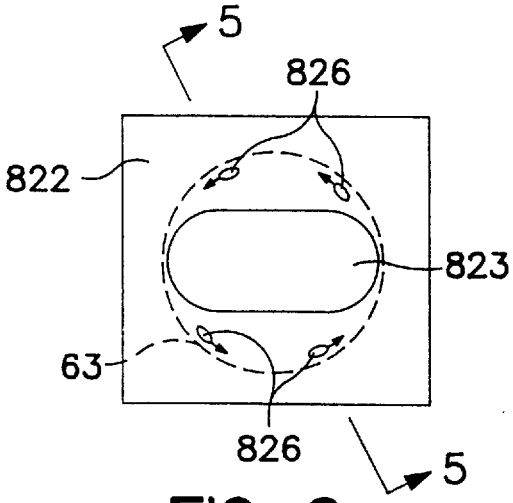
FIG. 6 is a view of the cleaning head shown in FIG. 5 showing also a projection of the inlet aperture of the rotor.

In the example of embodiment shown in FIGS. 1, 3, and 4, the cleaning device 82 contains a cleaning lever 821 swingingly mounted in a side wall 83 of the attending device 8 and coupled with a drive 827 controlled by the control unit 81. On the free end of the cleaning lever 821 is mounted a cleaning head 822, hollow and having in its front section an inlet hole 823 of a sucking-off tube 824. The sucking-off tube 824 consists of the cavity of the cleaning head 822 and of an immediately adjoining cavity 825 provided in the cleaning lever 821. The cavity 825 in the cleaning lever 821 is, via an air filter 84, connected to an underpressure source 85 represented in the shown embodiment by a blower or by a vacuum pump mounted on the attending device 8. However, the underpressure source may be also a central underpressure source of the machine to which the attending device 8 can be attached in a known way during the attendance of a working place. The cavity 825 in the cleaning lever 821 can be replaced for instance by a pipe or by a tube.

In the embodiment shown in FIGS. 3 to 6 and 9, the inlet hole 823 of the sucking-off tube 824 is extended (elongated) and its length corresponds with the diameter of the inlet aperture of the rotor 6. The short sides of the extended inlet hole 823 of the sucking-off tube 824 are rounded with a diameter equal or inferior to the diameter 63 of the rotor 6. In the front section of the cleaning head 822, there are provided along the long sides of the extended (elongated) inlet hole 823 of the sucking-off tube 824 cleaning jets 826 of cleaning pressure air coupled with the control unit 81 via not represented air supply control means. In the shown embodiment, four cleaning jets 826 are situated at equal distance from each other. In their cleaning position, in which the front section of the cleaning head 822 is situated opposite the inlet aperture of the rotor 6, the cleaning jets 826 are positioned uniformly inside the inner circumference of the inlet aperture of the rotor 6. In the cleaning position, there is a gap between the cleaning head 822 and the rotor 6 preventing them from contact with each other, which prevention is necessary in particular in passive rotors 6 which may turn at reduced speed during the cleaning or in cases where an active rotor 6 is not yet completely stopped or well braked and still turns, in order to avoid damages to the rotor 6 by the cleaning head 822. "Active rotors" 6 are termed those having ventilation holes and producing underpressure by their own rotation. "Passive rotors" 6 are those made of full material and seated in an underpressure chamber in which is produced the underpressure required for feeding singled-out fibres to the rotor 6. The inlet hole 823 of the sucking-off tube 824 lies between the cleaning jets 826 that are so arranged around it that their mouths lie on a circle whose centre lies in the cleaning position in the axis of the rotor 6.

Figure 9:
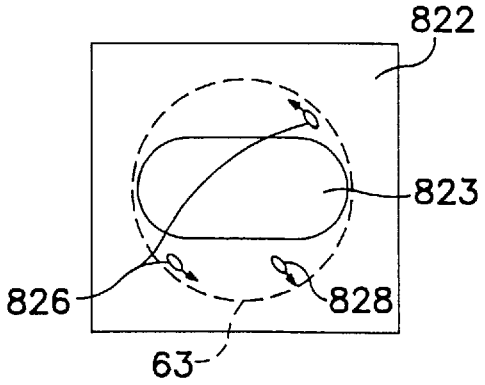
FIG. 9 is a view of a cleaning head with an extended inlet aperture, with cleaning jets, with an ancillary jet, and with a projection of the inlet aperture of the rotor.

If the above conditions are fulfilled, this embodiment permits to use also another number of cleaning jets 826, but at least two, as shown in FIG. 9. If, in the embodiment of the sucking-off tube 824 with the extended (elongated) inlet hole 823, two cleaning jets 826 are provided, they are situated at the ends of a line segment whose middle is in the cleaning position in the axis of the rotor 6. At the same time, the two cleaning jets 826 are situated near the inlet hole 823 of the sucking-off tube 824, and namely in the direction opposite to that of the air outflow from these cleaning jets 826, thus achieving near perfect rinsing of the inner space of the rotor 6 by the cleaning air and removal of the gathered fibres and all impurities.

In all embodiments with extended (elongated) inlet hole 823 of the sucking-off tube 824, this condition is complied with by cleaning jets 826 that are opposite the streaming direction of air flowing out of the cleaning jets 826 as nearest to the extended (elongated) inlet hole 823. of the sucking-off tube 824 while the other cleaning jets 826 support this air streaming in the rotor 6.

All of the cleaning jets 826 are directed into the inner space of the rotor 6 obliquely to its inner surface under one and the same angle.

Figure 7:
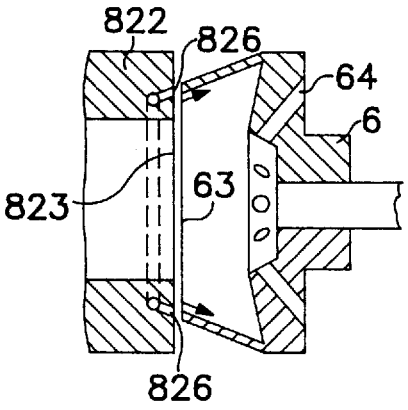
FIG. 7 is a sectional view of a cleaning head with circular inlet aperture in its cleaning position, and of the rotor.
Figure 8:
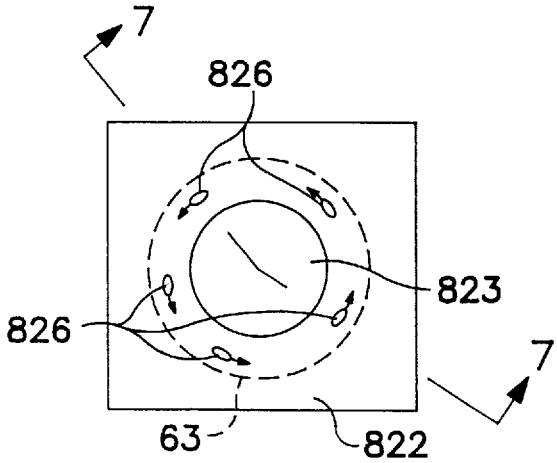
FIG. 8 is a view of the cleaning head shown in FIG. 7 showing also a projection of the inlet aperture of the rotor.
Figure 10:
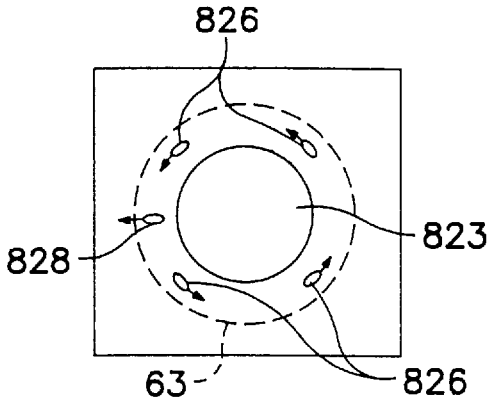
FIG. 10 is a view of a cleaning head with a circular inlet aperture, with cleaning jets, with an ancillary jet, and with a projection of the inlet aperture of the rotor.

The inlet hole 823 of the sucking-off tube 824 can also be of another shape, for instance a circular one, as shown in FIGS. 7, 8 and 10. In this case, its diameter is inferior to that of the inlet aperture of the rotor 6, while at least two cleaning jets 826 are uniformly disposed along its circumference, and they can be also uneven in number.

To increase the reliability of fibre band removal from the rotor 6, the cleaning head 822 can be equipped with at least one ancillary jet 828 situated next to the inlet hole 823 of the sucking-off tube 824 and directed to the inner surface of the rotor 6 at an angle different from that of the cleaning jets 826, as shown in FIGS. 9 and 10. The ancillary jet 828 is coupled with the control unit 81 of the attending device 8 by means of not represented well-known pressure air supply control means.

Also, the cleaning device 82 can be mounted on each spinning unit of the machine, and the attending device 8 can only serve to open the spinning unit and possibly to communicate with, and/or control, the cleaning device 82.

Before any attempt to reinstall the spinning process on the machine working place in question, the attending device 8 opens the spinning unit in a well-known manner. After the spinning unit has been opened, a signal given by the control unit 81 makes a not represented drive turn the cleaning lever 821 of the cleaning device 82 to its cleaning position in which the cleaning head 822, situated at the extremity of the cleaning lever 821, comes to lie before the inlet aperture 63 of the rotor 6 without touching the rotor 6. In this cleaning position, the inlet hole 823 of the sucking-off tube 824 provided in the cleaning head 822 of the cleaning lever 821 lies opposite the central part of the inlet aperture 63 of the rotor 6. The cleaning jets 826 are directed into the inner space of the rotor 6 and the cleaning air streams flowing out of the jets fall at one and the same angle on the selected section of the inner surface of the rotor 6. Since the volume of air sucked off by the sucking-off tube 824 is superior to that of the cleaning and/or ancillary air supplied to the rotor 6, a part of air which gets sucked into the inlet hole 823 of the sucking-off tube 824 is through the gap between the rotor 6 and the cleaning head 822 thus preventing the impurities from leaving the rotor 6 into ambient space. In active rotors 6, a part of air is in this way sucked also through the ventilation holes 64, thus cleaning the ventilation holes 64 and preventing the impurities from getting out through these ventilation holes 64.

In the machines in which the rotor 6 is completely stopped after the opening of the spinning unit, the cleaning head 822 of the cleaning lever 821 can be laid immediately to the inlet aperture 61 of the rotor 6 thus increasing the reliability of fibre and impurity removal from the rotor 6. However, in this case, the spinning unit or the attending device 8 must be equipped with a schematically represented monitor (821*d* in FIG. 1) of the rotor 6 rotation coupled with the control unit 81 or with another control mechanism of the cleaning device 82 in such a way that a signal of the monitor indicating the not yet stopped rotation of the rotor 6 makes the control unit 81 prevent the cleaning head 822 from being placed immediately to the inlet hole 823 of the sucking-off tube 824.

Before the cleaning position has been reached, the control unit 81 gives out an instruction to connect the sucking-off tube to a well-known not represented underpressure source 85. Insofar as freely laid, the fibres gathered in the rotor 6 can be sucked off. However, this is not the regular case and therefore the control unit 81 gives out the signal to connect the cleaning jets 826 to the underpressure cleaning air source after the cleaning position has been reached. This signal is given out by the control unit 81 as a rule only after the sucking-off tube 824 has been connected to the underpressure source, at the earliest simultaneously with this connecting, in order to ensure perfect delivery of cleaning pressure air supplied to the rotor 6.

In another embodiment, the sucking-off tube 824 can be connected to the underpressure source as a function of the position of the cleaning lever 821, at the latest at the reaching of the cleaning position.

An earlier connection of the sucking-off tube 824 to the underpressure source 85 prevents the fibres gathered in the rotor 6 from falling out after the opening of the spinning unit in the cases in which the fibres in the rotor 6 are free and upon the opening of the spinning unit begin to move out of the rotor 6. These fibres are then sucked off by the sucking-off tube 824 of the cleaning lever 821 during the motion of the latter towards the rotor 6 before the cleaning position has been reached.

The cleaning jets 826 supply to the inner space of the rotor 6 at least two streams of cleaning air which produce in the rotor 6 a symmetrical streaming in one and the same direction. The cleaning air being supplied loosens in the rotor 6 gathered fibres and clung impurities which, due to the underpressure existing in the suction-off tube 824, together with the air get caught and fed into the central part of the rotor 6 and from there are delivered through the inlet hole 823 of the sucking-off tube 824 situated opposite the central part of the inlet aperture 63 of the rotor 6. Through the cavity 825 of the cleaning lever 821, the fibres and impurities with the sucked-off air are then delivered to a not represented piping through which they enter the air filter 84.

The control unit 81 controls well-known not represented control means of air supply to the cleaning jets 826. Thus, for instance, when fibres get accumulated in the rotor 6 in considerable quantity, the cleaning air supply to cleaning jets 826 can be interrupted and after a time period resumed while the underpressure in the inlet hole 823 of the sucking-off tube 824 is in permanent uninterrupted action. The interruption of the cleaning air supply to the cleaning jets 826 can be repeated several times.

Experiments have shown that the best results in the removal of fibres gathered in the rotor 6 can be obtained if the time interval of the cleaning air supply before the first interruption of the cleaning air supply is shorter than the subsequent intervals. The interruption of the cleaning air supply to the cleaning jets 826 improves the cleaning of the ventilation holes 64 because during the interruption of the cleaning air supply, ambient air is sucked into the inner space of the rotor 6 through the ventilation holes 64 of the rotor 6.

Another variant of the device is intended especially for cleaning the rotor 6 when spinning synthetic fibres which are hard to remove from the rotor 6. Therefore, into the rotor 6 there is supplied in addition at least one ancillary air stream in a direction different from that of the air streams coming from the cleaning jets 826. The ancillary air stream is supplied by means of an ancillary jet 828 equipped with well-known air supply control means controlled by the control unit 81.

The control unit 81 can let the air stream pass through the ancillary jets at any suitable moment and for a predetermined time period. Also, the ancillary air stream can be put in action repeatedly.

It is suitable to supply the ancillary air stream to the rotor 6 for the first time before the first interruption of the cleaning air supply or during this interruption.

The fibres are gathered in the rotor 6 in the shape of a ring which is, in the case of synthetic fibres, only put in rotary motion by the cleaning air stream and only by the ancillary air stream supplied is the ring deformed whereupon some part of it is caught by the stream of sucked off air entering the inlet hole 823 of the sucking off tube 824, and the whole fibre ring is drawn into the inlet hole 823 and removed from the rotor 6.

It should be apparent to those skilled in the art that various modifications and variations can be made in the present invention without departing from the scope and spirit of the invention. For example, features illustrated or described as part of one embodiment can be used on another embodiment to yield still a further embodiment. It is intended that the present invention cover such modifications and variations as come within the scope of the appended claims and their equivalents.

We claim:

1. A method of cleaning a spinning rotor of a rotor spinning textile machine, the spinning rotor defining an inlet aperture and an interior, said method including the steps of:

aligning a pneumatic cleaning device in front of the spinning rotor;

introducing a plurality of air streams from the cleaning device into the spinning rotor interior in a direction with respect to the spinning rotor interior to create a resulting combined air stream circulating within the spinning rotor interior to loosen impurities therein; and simultaneously drawing the combined air stream and loosened impurities from the spinning rotor interior generally out the central part of the inlet aperture of the rotor in a removal air stream that is generally surrounded by the circulating air stream within the spinning rotor interior.

2. The method as in claim 1 wherein air is drawn out from the spinning rotor interior at a rate greater than that at which air is introduced to the spinning rotor interior by the combined plurality of air streams.

3. The method as in claim 1 wherein the plurality of air streams are introduced into the spinning rotor interior at equidistant positions on a circle defined within an edge of the rotor interior.

4. The method as in claim 3, wherein the resulting air stream circulates in a circular flow.

5. The method as in claim 1, wherein said introduction of air streams is at least once interrupted for a predetermined time period and thereafter resumed.

6. The method as in claim 5, wherein said introduction of air streams is interrupted at predetermined time intervals.

7. The method as in claim 6, wherein the first said time interval is shorter than all following said time intervals.

8. The method as in claim 6, including introducing at least one ancillary air stream into the spinning rotor interior in a direction different from the direction at which the plurality of air streams are introduced, wherein the ancillary air stream is introduced prior to said first interruption of air streams.

9. The method as in claim 5, including introducing an ancillary air stream into the spinning rotor interior in a direction different from the direction at which the plurality of air streams are introduced, wherein the ancillary air stream is introduced during at least a first of said interruptions of air streams.

10. The method as in claim 1, including introducing at least one ancillary air stream into the spinning rotor interior in a direction different from the direction at which the plurality of air streams are introduced.

* * * * *